US006079330A

United States Patent [19]

Aoki et al.

[11] Patent Number: 6,079,330

[45] Date of Patent: Jun. 27, 2000

[54] ROTARY PRESS HAVING A HEATING ROLLER FOR DRYING

[75] Inventors: Shigeru Aoki, Yachio; Noriyuki Shiba, Tokyo; Yoshinori Uera; Kazuyuki Motojima, both of Kawasaki, all of Japan

[73] Assignees: Tokyo Kikai Seisakusho, Ltd.; Tonichi Printing Co., Ltd., both of Tokyo, Japan

[21] Appl. No.: 08/956,037

[22] Filed: Oct. 24, 1997

[30] Foreign Application Priority Data

Jan. 24, 1997 [JP] Japan ..... 9-024465

[51] Int. Cl.[7] ..... B41F 23/04

[52] U.S. Cl. ..... 101/424.1; 101/487

[58] Field of Search ..... 101/424.1, 487, 101/488, 416.1, 225, 219, 181, 178; 492/46

[56] References Cited

U.S. PATENT DOCUMENTS

| | | | |
|---|---|---|---|
| 4,510,864 | 4/1985 | Klemm | 101/123 |
| 4,729,918 | 3/1988 | Nueberg et al. | 428/207 |
| 5,108,531 | 4/1992 | Quadacci | 101/424.1 |
| 5,188,028 | 2/1993 | Reichel | 101/487 |
| 5,203,756 | 4/1993 | Taguchi | 492/16 |
| 5,218,905 | 6/1993 | Bolte et al. | 101/348 |
| 5,553,729 | 9/1996 | Kitano et al. | 219/619 |
| 5,619,927 | 4/1997 | Winheim | 101/487 |
| 5,805,969 | 9/1998 | Elsermans et al. | 399/341 |

FOREIGN PATENT DOCUMENTS 63-106635 7/1988 Japan .

1-156933 10/1989 Japan .

OTHER PUBLICATIONS

Japanese Utility Model Laying–open of Application 48–57104.

Japanese Patent Laying–open of Application 8–296142.

Japanese Patent Laying–open of Application 4–77255.

Rotary Offset Printing (Nippon Insatsu Shimbun–sha, 1st. Edition), pp. 11, 12, 35–41.

*Primary Examiner*—John S. Hilten

*Assistant Examiner*—Anthony H. Nguyen

*Attorney, Agent, or Firm*—Armstrong, Westerman, Hattori, McLeland & Naughton

[57] ABSTRACT

A rotary press has a paper web supply apparatus, a printing apparatus, and a post-printing processing apparatus. The rotary press further includes at least one heating roller provided in a path along which a paper web carrying printed images runs from the printing apparatus to the post-printing processing apparatus, as well as at least one cooling roller provided downstream from the heating roller. The heating roller and the cooling roller are disposed such that the running paper web contacts each of the rollers over at least one-fourth of the circumference thereof. The heating roller is rotated at a circumferential speed different from a running speed of the paper web. The heating roller is a cylindrical body equipped with a built-in coil to which alternating current is supplied. The heating roller has cavities which are formed in a mutually communicating manner in the wall thereof and are filled with a thermal medium, and the outer surface of the heating roller is roughened. The rotary press can decrease installation space, the degree of complexity, manufacturing cost, and running cost of the drying apparatus.

12 Claims, 4 Drawing Sheets

ROTARY PRESS HAVING A HEATING ROLLER FOR DRYING

BACKGROUND OF THE INVENTION

1. Field of the Invention

The present invention relates to a rotary press for printing on paper web and for processing printed paper web, and particularly to a rotary press wherein printed paper web is heated and then cooled so as to stabilize the ink of an image printed on the paper web, and subsequently the printed paper web is processed.

2. Description of the Related Art

A rotary press for printing on paper web generally performs post-printing processes, such as folding and cutting, as well as printing. For example, as shown in FIG. 4, a schematic version of FIG. 2-1 on page 11 of "Rotary Offset Printing" (Nippon Insatsu Shinbun-sha, First Edition, Oct. 20, 1990), such a rotary press comprises a paper web supply section, a paper web feed section (the paper web supply section and the paper web feed section constitute a paper web supply apparatus), a printing section (printing apparatus), a drying section (drying apparatus), a cooling section (cooling apparatus), a first folder, and a second folder (the first and second folders constitute a post-printing processing apparatus).

The drying apparatus in such a conventional rotary press is intended to "evaporate a solvent for ink within the drying apparatus by heating," as described in the aforementioned "Rotary Offset Printing," page 35, left column, "4. Drying apparatuses and Cooling Roller Units," lines 11–12. Further, as described in the same literature, the same page, right column, lines 5–6, "at present, most drying apparatuses are of the full hot-air type, in which hot air discharged from nozzles blows against paper web."

Such a drying apparatus has a relatively long linear path of paper web so as to blow hot air against both sides of paper web running through the path, as described in the above-cited "Rotary Offset Printing," from page 36, left column, line 4, to page 39, left column, line 2, or in Japanese Utility Model Application Laid-Open (kokai) No. 1-156933. Thus, the structure of the drying apparatus is complex and large scaled. As shown in FIG. 4, such a drying apparatus is very large as compared with a printing apparatus.

Also, a conventional drying apparatus disclosed in Japanese Utility Model Application Laid-Open (kokai) No. 63-106635 comprises heating rollers and nozzles. The heating rollers are disposed so as to contact running paper web on both sides thereof. The nozzles are arranged so as to blow hot air against the running paper web from both sides thereof in the vicinity of and on the upstream and downstream sides of the heating rollers. Thus, the paper web is heated by the heating rollers as well as by hot air.

This drying apparatus may replace the aforementioned full hot-air type drying apparatus.

The drying apparatus disclosed in Japanese Utility Model Application Laid-Open (kokai) No. 63-106635 is intended to improve heating efficiency, which is rather poor when heating is performed only by hot air. As described in the specification, since the contact between the heating rollers and the paper web is instantaneous, the heating effect of the heating rollers is very small. Thus, combined use of the heating rollers and hot air is unavoidable. Accordingly, like a full hot-air type drying apparatus, this drying apparatus has a structure which is complex and large scaled as compared to that of the printing apparatus.

Since the above-mentioned conventional drying apparatuses which utilize hot air are large scaled, a rotary press equipped with such a drying apparatus requires a wide space for installation thereof.

Because of the complex and large-scaled structure, the above-described conventional drying apparatuses have a high cost of manufacture. Accordingly, the installation of a rotary press equipped with such a drying apparatus requires great expense.

Further, since the above-mentioned conventional drying apparatuses require a large amount of hot air to be circulated over a relatively long path of running paper web, a large amount of energy is consumed, resulting in a high running cost for a rotary press equipped with such a drying apparatus.

SUMMARY OF THE INVENTION

The present invention has been accomplished to solve the above-mentioned problems of conventional rotary presses stemming from hot-air drying, and it is an object of the invention to provide a rotary press which can decrease installation space, cost of manufacture, and running cost.

The present invention provides a rotary press having a paper web supply apparatus, a printing apparatus, and a post-printing processing apparatus, wherein at least one heating roller is provided in a path along which a paper web carrying printed images runs from the printing apparatus to the post-printing processing apparatus. Further, at least one cooling roller is provided downstream from the heating roller. The heating roller and the cooling roller are disposed such that the running paper web contacts each of the rollers over at least one-fourth of the circumference thereof.

Preferably, the heating roller is rotated at a circumferential speed different from a running speed of the paper web.

The heating roller is, for example, a cylindrical body equipped with a built-in coil to which alternating current is supplied. Preferably, the heating roller has cavities which are formed in a mutually communicating manner in the wall thereof and are filled with a thermal medium. Preferably, the outer surface of the heating roller is roughened.

In the rotary press according to the present invention wherein the heating roller for drying is provided in a path of running paper web downstream from the printing apparatus, the drying apparatus has a smaller and simpler structure than do drying apparatuses of a conventional rotary presses. Thus, the rotary press of the invention features an economy of installation space and low cost.

In addition, since the structure of the drying apparatus is simpler than those of conventional rotary presses, the energy consumption and running cost can be reduced and handling becomes easier. Moreover, a failure rate reduces, and maintenance becomes easier.

Further, by making the heating roller rotate at a circumferential speed different from a running speed of paper web, the ink, whose resin component is thermally softened by heating, does not adhere to the outer surface of the heating roller, thereby keeping the heating roller clean.

In the case where cavities are formed in a mutually communicating manner in the wall of the heating roller and are filled with a thermal medium, a more uniform temperature distribution is established on the outer surface of the heating roller. Also, through employment of the roughened outer surface of the heating roller, the ink becomes less likely to adhere thereto, and air caught between paper web and the outer surface of the heating roller is effectively expelled.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE INVENTION AND PREFERRED EMBODIMENTS

Figure 1:
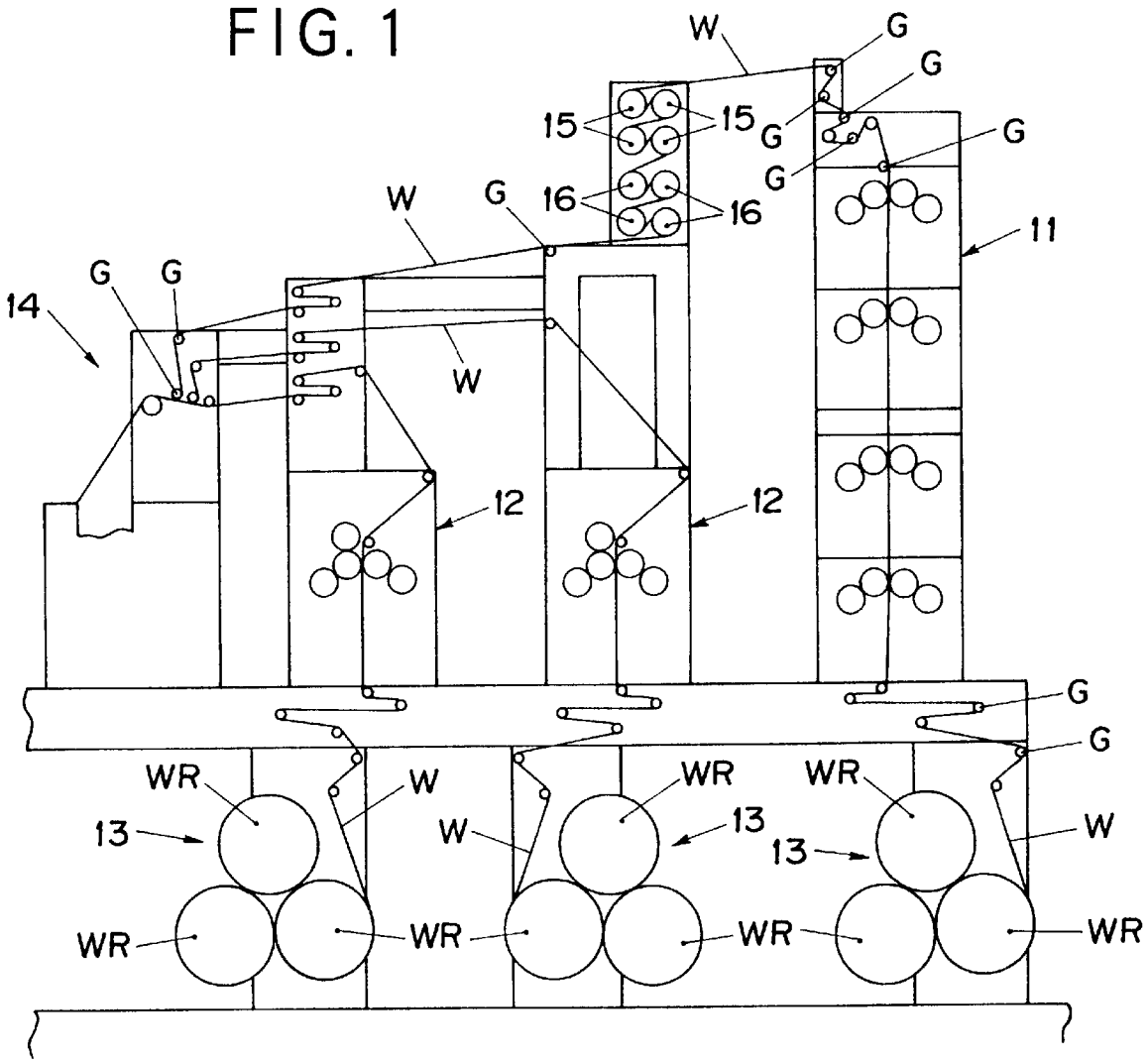
FIG. 1 is a schematic view showing the structure of a large-scaled offset rotary press capable of printing a newspaper or the like according to an embodiment of the present invention.

In the rotary press according to the present invention, paper web from a roll of paper in the paper web supply apparatus passes the printing apparatus along a predetermined path, runs along a series of heating rollers and then along a series of cooling rollers in a manner that the running paper web contacts each of the rollers over at least one-fourth of the circumference thereof, and then reaches the post-printing processing apparatus along the predetermined path.

The outer surfaces of the heating rollers are maintained at such a temperature as to heat the paper web in contact therewith to a predetermined temperature. The outer surfaces of the cooling rollers are maintained at such a temperature as to cool the paper web in contact therewith to a predetermined temperature.

In the cylindrical heating roller equipped with a built-in coil, when alternating current is supplied to the coil from a power source, magnetic flux is generated through the cylindrical body, which is opposed to the coil, to apply induced current within the cylindrical body. As a result, the cylindrical body, i.e. the heating roller is heated by resistance heat.

Accordingly, the heating roller does not require other auxiliary apparatus for heating purposes, thereby providing excellent space economy. Also, since a thermal medium is not circulated between the interior and the exterior of the heating roller, there is not involved a problem that the thermal medium leaks from a coupling of thermal medium circulation piping or other portions, and maintenance is hardly necessary. Further, since the heating roller itself generates heat, a heat loss is very small to thereby efficiently obtain thermal energy.

In the case where cavities filled with a thermal medium are formed within the wall of the heating roller, a more uniform temperature distribution is established on the surface of the heating roller.

The heating rollers heat paper web to a temperature necessary for evaporating a solvent from a printing ink.

Also, the cooling rollers cool the heated paper web to a temperature necessary for decreasing stickiness of a resin component of the ink, which resin component has been thermally softened due to heating by the heating rollers.

After the above-described conditions are established, printing by the rotary press is initiated.

Once printing starts, tension is applied to paper web so as to run the paper web from the paper web supply apparatus to the post-printing processing apparatus such as a folder.

While the running paper web passes the printing apparatus, printing is performed on the paper web, and subsequently the printed paper web reaches the heating rollers.

On arrival at the heating rollers, the paper web contacts each of the heating rollers over at least one-fourth of the circumference thereof. The paper web runs at a speed substantially identical to or different from the circumferential speed of the rotating heating rollers. While the paper web is in contact with the temperature-regulated outer surfaces of the heating rollers, the paper web is heated to a temperature adequate for evaporating a solvent from ink used to print images thereon. On the other hand, heating by the heating rollers causes the resin component of the ink to be thermally softened, so that stickiness of the resin component is maintained at a relatively high level. Accordingly, the ink is in a rather unstable state on the paper web, i.e. in a state such that the ink may easily adhere to other surfaces it may come in contact with.

In the case where the paper web is run at a speed different from the circumferential speed of the rotating heating rollers, the paper web slides on the outer surfaces of the heating rollers. Accordingly, the ink, which is in an unstable state on the paper web as described above, does not adhere to the outer surfaces of the heating rollers.

Then, after leaving the heating rollers, the paper web reaches the cooling rollers and contacts each of the cooling rollers over at least one-fourth of the circumference thereof. The paper web runs at a speed substantially identical to the circumferential speed of the rotating cooling rollers. While the paper web is in contact with the temperature-regulated outer surfaces of the cooling rollers, the paper web is cooled, so that the resin component of the ink hardens and thus decreases in stickiness. Accordingly, the ink is stabilized on the paper web and thus does not adhere to any other object.

Then, after leaving the cooling rollers, the paper web reaches the post-printing processing apparatus and is cut and folded therein. The thus-processed printed paper is ejected from the post-printing processing apparatus.

During processing (cutting and folding) in the post-printing processing apparatus and subsequent ejection and transport, even when the paper web being cut and folded, or cut and folded printings rub together or are pressed hard against each other, the ink which forms images is stable on the paper web or the printings. Thus, the ink does not adhere to any other object, and other relevant problems do not occur.

Embodiments of the present invention will now be described with reference to the drawings.

FIG. 1 shows a large-scaled offset rotary press capable of printing a newspaper or the like, which comprises a both sides printing press 11 capable of performing four-color printing on both sides of paper web W, two both sides printing presses 12 capable of performing two-color printing on one side of the paper web W, three paper web supply apparatuses 13 for feeding the paper webs W to respective printing presses 11 and 12, and a post-printing processing apparatus 14 such as a folder for cutting and folding the image-printed paper webs W coming from the respective printing presses 11 and 12. The offset rotary press of FIG. 1 further comprises four heating rollers 15 and subsequent four cooling rollers 16 provided in the path of the image-printed paper web W running from the both sides printing press 11 to the post-printing processing apparatus 14.

The heating rollers 15 are arranged in two columns such that the neighboring heating rollers 15 do not contact each other and are not too apart from each other, for example, such that the distance between the neighboring heating rollers 15 is smaller than the sum of their diameters and is appropriately larger than one half of the sum. The cooling rollers 16 are arranged subsequent to the heating rollers 15 also in two columns and such that the neighboring cooling rollers 16 do not contact each other and are not too apart from each other. The heating rollers 15 and the cooling rollers 16 are driven rotatively.

As shown in FIG. 1, the heating rollers 15 and the cooling rollers 16 are arranged in two columns such that the paper web W, which zigzags from one roller to the neighboring downstream roller, contacts each of the heating and cooling rollers 15 and 16 over at least one-fourth of the circumference thereof.

Figure 2:
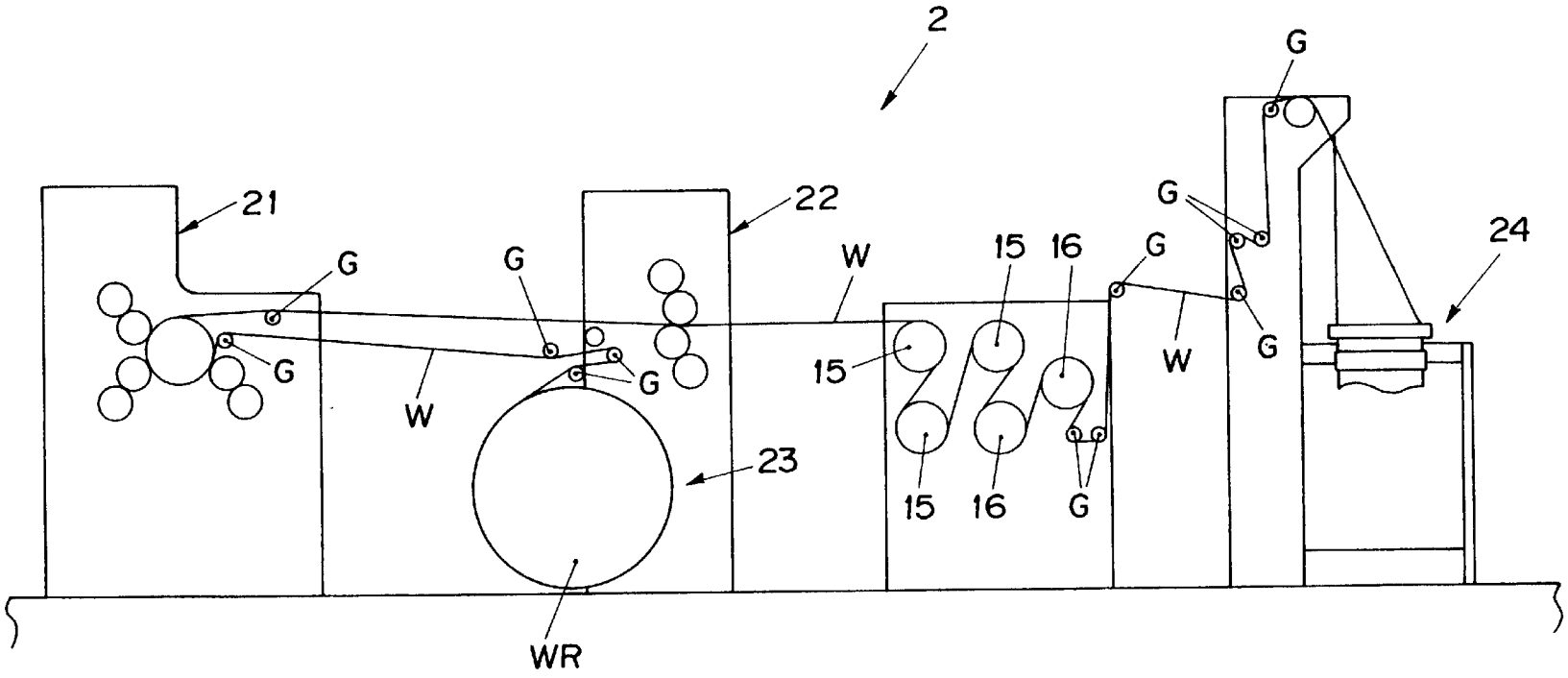
FIG. 2 is a schematic view showing the structure of a small-scaled offset rotary press according to another embodiment of the present invention.

FIG. 2 shows a small-scaled offset rotary press comprising a one-side printing press 21 capable of performing three-color printing on one side of paper web W, a both sides printing press 22 capable of performing monochrome printing on both sides of the paper web W, a paper web supply apparatus which accompanies the both sides printing press 22 in order to feed paper web W to the printing presses 21 and 23, and a post-printing processing apparatus 24 serving as a folder for cutting and folding the paper web W which has been image-printed by the printing presses 21 and 22. The offset rotary press of FIG. 2 further comprises three heating rollers 15 and subsequent two cooling rollers 16 provided in the path of the image-printed paper web W running from the both sides printing press 22 to the post-printing processing apparatus 24.

The heating rollers 15 are arranged such that the neighboring heating rollers 15 do not contact each other and are not too apart from each other, for example, such that the distance between the neighboring heating rollers 15 is smaller than the sum of their diameters and is appropriately larger than one half of the sum. The cooling rollers 16 are arranged subsequent to the heating rollers 15 and also such that the neighboring cooling rollers 16 do not contact each other and are not too apart from each other. The heating rollers 15 and the cooling rollers 16 are driven rotatively.

As shown in FIG. 2, the heating rollers 15 and the cooling rollers 16 are arranged such that the paper web W, which zigzags from one roller to the neighboring downstream roller, contacts each of the heating and cooling rollers 15 and 16 over at least one-fourth of the circumference thereof.

The number and the arrangement of the heating rollers 15 and the subsequent cooling rollers 16 are not limited to those of the above-described embodiments but may be selected appropriately so long as the object of the present invention is attained.

The post-printing processing apparatus 14 or 24 may not necessarily be a folder as illustrated but may be a take-up apparatus for taking up the paper web W or a cutter for cutting the paper web W into sheets.

In the rotary press 1 shown in FIG. 1 and the rotary press 2 shown in FIG. 2, the heating rollers 15 may be rotatively driven, by appropriate transmission means (e.g. a continuously-variable speed changer) or a gear train having an appropriate gear ratio, at a circumferential speed different from that of a rotary member located before or after the heating rollers 15 and serving as a web drawing mechanism (e.g. a press cylinder of the printing press 11 or 22 and the cooling roller 16 in FIGS. 1 and 2).

Through employment of the above arrangement, the circumferential speed of the heating roller 15 can be made different from the running speed of the paper web W, which runs at a speed substantially identical to that of the rotary member located before or after the heating rollers 15 and serving as a web drawing mechanism. This difference in speed prevents ink, whose resin component is thermally softened by heating, from adhering to the outer surface of the heating roller 15, thereby keeping the heating roller 15 clean.

The outer surface of the heating roller 15 is formed of chromium against rust and adhesion of ink. Further, in order to more effectively prevent ink from adhering the outer surface of the heating roller 15 and effectively expel air caught between paper web and the outer surface, the outer surface may be roughened through coating with, for example, a porous chromium layer or fine beads of glass or the like. Alternatively, the outer surface of the heating roller 15 may be formed of Teflon or the like in order to more effectively prevent ink from adhering thereto.

Further, the heating roller 15 may has a structure to circulate a thermal medium, such as heated oil, therethrough, may be equipped with a built-in heater serving as a heat source, or may has a structure to generate heat by itself.

Figure 3:
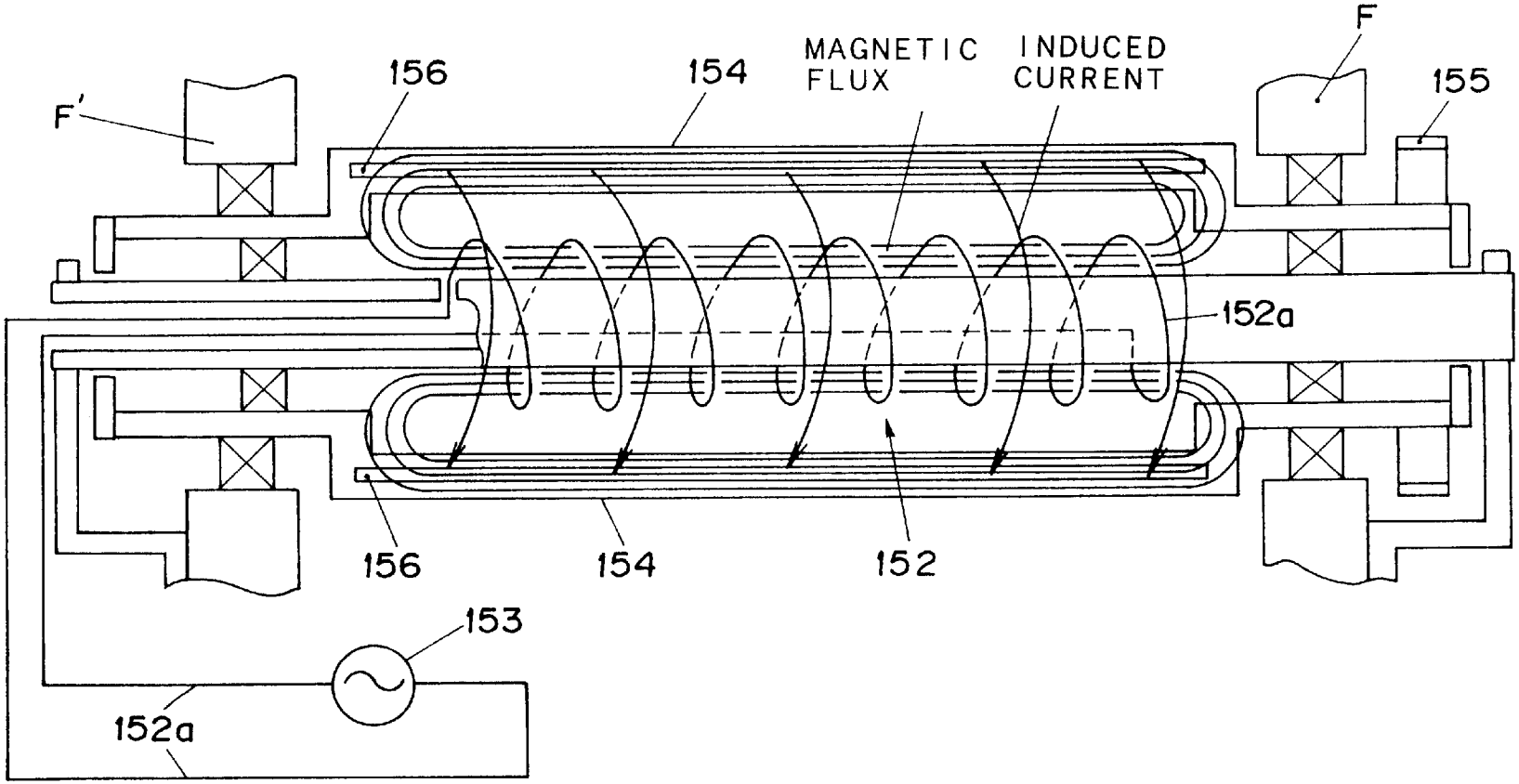
FIG. 3 is a schematic view showing the structure of a heating roller used in the embodiments of the present invention.
Figure 4:
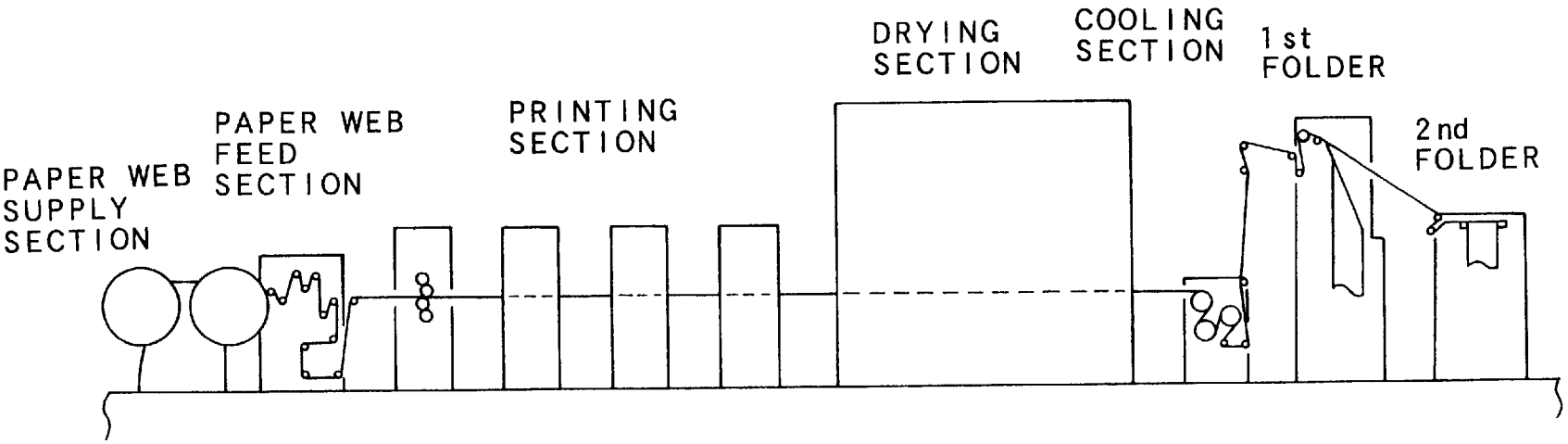
FIG. 4 PRIOR ART
FIG. 4 is a schematic view showing the structure of a conventional offset rotary press equipped with a hot-air type drying apparatus.

FIG. 3 shows the schematic structure of a heating roller which generates heat by itself.

A heating roller exemplified in FIG. 3 has the structure described below.

Both ends of a cylindrical core 151 project outward beyond corresponding frames F and F' and are fixed to the frames F and F' through respective brackets. A conductor 152*a* is wound around the outer surface of the cylindrical core 151 to thereby form a coil 152. Both ends of the conductor 152*a* extend within the cylindrical core 151 and are led out through one end of the cylindrical core 151 so as to be connected to a power source 153.

A rotary cylindrical outer sleeve 154 is provided to surround the coil 152. One end of the rotary cylindrical outer sleeve 154 is rotatably supported such that the inner and outer surfaces thereof are in contact with the outer surface of one end of the cylindrical core 151 and the frame F, respectively. Likewise, the other end of the rotary cylindrical outer sleeve 154 is rotatably supported such that the inner and outer surfaces thereof are in contact with the outer surface of the other end of the cylindrical core 151 and the frame F', respectively. That is, the rotary cylindrical outer sleeve 154 is rotatable relative to the stationary coil 152. Like the cylindrical core 151, both ends of the rotary cylindrical outer sleeve 154 project outward beyond corresponding frames F and F'. A transmission gear 155 is attached to one end of the rotary cylindrical outer sleeve 154.

The cylindrical core 151 may be divided into a plurality of regions in an axial direction thereof, and each of the regions may be provided with the coil 152 in an independent manner. In this case, the individual coils 152 may be supplied with power and controlled independently of each other. This arrangement allows heat generation in the rotary cylindrical outer sleeve 154 at a portion corresponding to a selected region.

Particularly preferably, cavities are formed in the wall of the rotary cylindrical outer sleeve 154 in a mutually communicating manner. For example, a number of cavities 156 are formed in the wall of the rotary cylindrical outer sleeve 154 in parallel with an axial direction. The cavities 156 communicate each other at least at single ends thereof through circular cavities and are filled with an appropriate thermal medium.

The cooling roller 16 may has a structure that a cooling medium, such as water cooled below room temperature, circulates through the interior thereof.

The temperature of the outer surface of the heating roller 15 is controlled through control of the temperature of the thermal medium. Alternatively, the temperature of the outer surface is detected in order to control the power supply to a heater or a built-in coil on the basis of the detected temperature. The temperature of the outer surface of the cooling roller 16 is controlled through control of the cooling medium.

The operation of the above-described embodiments of the rotary press according to the present invention will now be described.

In the rotary press 1 shown in FIG. 1, the paper web W extending from a roll of paper WR in the paper web supply apparatus 13 is guided along guide rollers G, passes the printing press 11, and then reaches the heating rollers 15 and the cooling rollers 16 arranged in two columns. As shown in FIG. 1, the paper web W travels along a series of the heating rollers 15 and then along a series of the cooling rollers 16 such that the paper web W, which zigzags from one roller to the neighboring downstream roller, contacts each of the heating and cooling rollers 15 and 16 over at least one-fourth of the circumference thereof. Subsequently, being guided along guide rollers G and turning bars (not shown), the paper web W reaches the post-printing processing apparatus 14 such as a folder.

In the rotary press 2 shown in FIG. 2, the paper web W extending from a roll of paper WR in the paper web supply apparatus 23 is guided along guide rollers G, passes the printing presses 21 and 22, and then reaches the heating rollers 15 and the cooling rollers 16. As shown in FIG. 2, the paper web W travels along a series of the heating rollers 15 and then along a series of the cooling rollers 16 such that the paper web W, which zigzags from one roller to the neighboring downstream roller, contacts each of the heating and cooling rollers 15 and 16 over at least one-fourth of the circumference thereof. Subsequently, being guided along guide rollers G and turning bars (not shown), the paper web W reaches the post-printing processing apparatus 24 serving as a folder.

The operation and the effect of the heating rollers 15 and the cooling rollers 16 are equivalent between the rotary press 1 of FIG. 1 and the rotary press 2 of FIG. 2, and will thus be described only for the rotary press 1.

The outer surfaces of the heating rollers 15 are maintained at a temperature to heat the paper web W in contact therewith to a predetermined temperature. The outer surfaces of the cooling rollers 16 are maintained at a temperature to cool the paper web W in contact therewith to a predetermined temperature.

In the cylindrical heating roller 150 of FIG. 3, when alternating current is supplied to the coil 152 from the power source 153, magnetic flux is generated through the rotary cylindrical outer sleeve 154, which is opposed to the coil 152, to thereby apply induced current in the rotary cylindrical outer sleeve 154. As a result, the rotary cylindrical outer sleeve 154 is heated by resistance heat.

Accordingly, the heating roller 150 does not require other auxiliary apparatus for heating purposes, thereby providing excellent space economy. Also, since a thermal medium is not circulated between the interior and the exterior of the heating roller 150, there is not involved a problem that the thermal medium leaks from a coupling of thermal medium circulation piping or other portions, and maintenance is hardly necessary. Further, since the heating roller 150 itself generates heat, a heat loss is very small to thereby efficiently obtain thermal energy.

In the case where the cavities 156 filled with a thermal medium are formed within the wall of the heating roller 150, a more uniform temperature distribution is established on the surface of the heating roller 150.

The heating rollers 15 heat the paper web W to a temperature necessary for evaporating a solvent from a printing ink, specifically an appropriate temperature of 90° C. to 170° C.

Also, the cooling rollers 16 cool the heated paper web W to a temperature necessary for decreasing stickiness of a resin component of the ink, which resin component has been thermally softened due to heating by the heating rollers 15. Specifically, the heated paper web W is cooled to a temperature of or below approximately 30° C.

After the above-described conditions are established, printing by the rotary press 1 or 2 is initiated.

Once printing starts, tension is applied to the paper web W by rotary elements disposed along the path of the paper web W and serving as web drawing mechanisms (e.g. an infeed roller located upstream of a printing press, a press cylinder, the heating roller 15, the cooling roller 16, and a drag roller of a folder). The tension-applied paper web W runs from the paper web supply apparatus 13 or 23 to the post-printing processing apparatus 14 or 24 such as a folder.

While the running paper web W passes the printing press 11 or the printing presses 21 and 22, printing is performed on the paper web W, and subsequently the printed paper web W reaches the heating rollers 15.

On arrival at the heating rollers 15, the paper web W contacts each of the heating rollers 15 over at least one-fourth of the circumference thereof. The paper web W runs at a speed substantially identical to the circumferential speed of the rotating heating rollers 15, or at a speed substantially identical to the circumferential speed of any other rotary member serving as a paper drawing mechanism and different from the circumferential speed of the heating rollers 15.

While the paper web W is in contact with the temperature-regulated outer surfaces of the heating rollers 15, the paper web W is heated to a temperature of 90° C. to 170° C. adequate for evaporating a solvent from ink used to print an image thereon. On the other hand, heating by the heating rollers 15 causes a resin component of the ink to be thermally softened, so that stickiness of the resin component is maintained at a relatively high level. Accordingly, the ink is in a rather unstable state on the paper web, i.e. in a state such that the ink may easily adhere to other surfaces it may come in contact with.

In the case where the paper web W is run at a speed different from the circumferential speed of the rotating heating rollers 15, the paper web W slides on the outer surfaces of the heating rollers 15. Accordingly, the ink, which is in an unstable state on the paper web W as described above, does not adhere to the outer surfaces of the heating rollers 15.

Then, after leaving the heating rollers 15, the paper web W reaches the cooling rollers 16 and contacts each of the cooling rollers 16 over at least one-fourth of the circumference thereof. The paper web W runs at a speed substantially identical to the circumferential speed of the rotating cooling rollers 16. While the paper web W is in contact with the temperature-regulated outer surfaces of the cooling rollers 16, the paper web W is cooled to a temperature of or below approximately 30° C., so that the resin component of the ink used to print an image on the paper web W hardens and thus decreases in stickiness. Accordingly, the ink is stabilized on the paper web W and thus does not adhere to any other object.

Then, after leaving the cooling rollers 16, the paper web W reaches the post-printing processing apparatus 14 or 24 and is cut and folded therein. The thus-processed printed paper is ejected from the post-printing processing apparatus 14 or 24.

During processing (cutting and folding) in the post-printing processing apparatus 14 or 24 and subsequent ejection and transport, even when the paper web W being cut and folded, or cut and folded printings rub together or are pressed hard against each other, the ink which forms images is stable on the paper web W or the printings. Thus, the ink does not adhere to any other object, and other relevant problems do not occur.

Obviously, numerous modifications and variations of the present invention are possible in light of the above teachings. It is therefore to be understood that within the scope of the appended claims, the present invention may be practiced otherwise than as specifically described herein.

What is claimed is:

1. A rotary press having a paper web supply apparatus for continuously feeding a paper web to be printed, a printing apparatus for receiving and continuously printing said paper web to be printed, and a post-printing processing apparatus for receiving and processing said continuously printed paper web, said rotary press further comprising:

a plurality of heating rollers arranged in two columns such that adjacent said heating rollers do not contact each other, with the distance between adjacent said heating rollers being smaller than the sum of their diameters and larger than one half the sum of their diameters, at a downstream side of said printing apparatus in a path along which a paper web carrying printed images runs from the printing apparatus to the post-printing processing apparatus, for receiving and heating said continuously printed paper web to a temperature of evaporating solvent from a printing ink;

at least one cooling roller at a downstream side of said plurality of heating rollers for receiving and cooling the resultant heated printed paper web, wherein said plurality of heating rollers and said cooling roller are disposed such that the running paper web contacts each of said rollers over at least one-fourth of an outer circumference of said heating roller and an outer circumference of said cooling roller.

2. A rotary press according to claim 1, wherein said heating roller is rotated at a circumferential speed different from a running speed of the paper web.

3. A rotary press according to claim 1, wherein said heating roller has a cylindrical hollow body having a cylindrical outer wall with a built-in coil to which alternating current is supplied to said coil so as to be induced so that the induced current flows within said wall.

4. A rotary press according to claim 2, wherein said heating roller is a cylindrical hollow body having a cylindrical outer wall with a built-in coil to which alternating current is supplied to said coil so as to be induced and then the induced current flows within said outer wall.

5. A rotary press according to claim 3, wherein said heating roller has communicating cavities which are formed in a wall thereof and are filled with a thermal medium.

6. A rotary press according to claim 4, wherein said heating roller has communicating cavities which are formed in said wall thereof and are filled with a thermal medium.

7. A rotary press according to claim 1, wherein a cylindrical outer wall of said heating roller has a roughened outer circumferential surface.

8. A rotary press according to claim 2, wherein a cylindrical outer wall of said heating roller has a roughened outer circumferential surface.

9. A rotary press according to claim 3, wherein a cylindrical outer wall of said heating roller has a roughened outer circumferential surface.

10. A rotary press according to claim 4, wherein a cylindrical outer wall of heating roller has a roughened outer circumferential surface.

11. A rotary press according to claim 5, wherein a cylindrical outer wall of said heating roller has a roughened outer circumferential surface.

12. A rotary press according to claim 6, wherein a cylindrical outer wall of said heating roller has a roughened outer circumferential surface.

* * * * *